US007604001B2

(12) United States Patent
Craghead

(10) Patent No.: US 7,604,001 B2
(45) Date of Patent: Oct. 20, 2009

(54) KITCHEN COOKTOP SYSTEM

(76) Inventor: John W. Craghead, 11394 CR 308, Llano, TX (US) 78643

( * ) Notice: Subject to any disclaimer, the term of this patent is extended or adjusted under 35 U.S.C. 154(b) by 355 days.

(21) Appl. No.: 11/445,920

(22) Filed: Jun. 2, 2006

(65) Prior Publication Data

US 2006/0289450 A1 Dec. 28, 2006

Related U.S. Application Data

(60) Provisional application No. 60/687,011, filed on Jun. 3, 2005.

(51) Int. Cl.
*F24C 15/10* (2006.01)

(52) U.S. Cl. ..... 126/211; 126/215; 126/220; 126/304 A; 134/137; 134/140; 134/172

(58) Field of Classification Search ..... 126/38, 126/37 B, 39 R, 41 R, 29–30, 211, 215, 220, 126/304 A; 4/546, 564.1, 563.1, 565.1, 566.1, 4/638; 134/105, 115 G, 137, 140, 104.2, 134/196, 198, 172; 137/382; 239/312; 99/327, 99/329 P, 443 R See application file for complete search history.

(56) References Cited

U.S. PATENT DOCUMENTS 1,266,167 A * 5/1918 Sears ..... 134/77
2,015,295 A * 9/1935 Steingruber ..... 219/218
2,238,969 A * 4/1941 Butterfield ..... 239/312
2,512,452 A * 6/1950 Wilson ..... 134/141
2,527,566 A * 10/1950 Miller ..... 219/418
2,620,785 A * 12/1952 Zimmermann ..... 126/1 R
2,658,985 A * 11/1953 Maxwell ..... 219/414
2,758,588 A * 8/1956 Lozano ..... 126/1 R
2,944,271 A * 7/1960 Foster et al. ..... 15/28
2,944,540 A * 7/1960 Littell, Jr. ..... 126/273 A
2,996,597 A * 8/1961 Persinger et al. ..... 219/474
3,028,209 A * 4/1962 Hinkel et al. ..... 312/319.7
3,187,664 A * 6/1965 Jennings ..... 99/329 R
3,472,219 A * 10/1969 Roy et al. ..... 126/37 R
3,501,316 A * 3/1970 Guthrie, Sr. ..... 426/296
3,502,384 A * 3/1970 Gipson ..... 312/228
3,608,473 A * 9/1971 Kearn et al. ..... 99/336
3,627,396 A * 12/1971 Miller ..... 312/49
3,650,591 A * 3/1972 Longmire, Sr. ..... 312/312
3,680,567 A * 8/1972 Hansen ..... 134/57 D
3,690,246 A * 9/1972 Guthrie, Sr. ..... 99/336
3,821,925 A * 7/1974 Moore ..... 99/327
3,958,503 A * 5/1976 Moore ..... 99/327
3,986,891 A 10/1976 Rumbaugh
4,031,820 A * 6/1977 Reed ..... 99/336
4,033,461 A * 7/1977 Nevai ..... 211/85.25
4,397,508 A * 8/1983 Bohnet et al. ..... 312/312
4,400,045 A * 8/1983 Baschin ..... 312/236
4,420,006 A * 12/1983 Moore et al. ..... 134/167 R
4,704,290 A * 11/1987 Fritzsche ..... 426/438

(Continued)

*Primary Examiner*—Kenneth B Rinehart
*Assistant Examiner*—Jorge Pereiro

(57) ABSTRACT

A cooking apparatus including a cooking appliance mounted over a sink basin so that the cooking appliance can be rinsed into the sink. The cooking appliance can preferably be raised vertically, from a lowered position where the base of the cooktop is seated into the sink basin to a raised position where the sides and bottom of the cooking appliance are easily accessible for cleaning or service. A hot water connection is preferably mounted so as to be able to provide water to both the sink basin and the exterior surfaces of the cooking appliance.

16 Claims, 3 Drawing Sheets

U.S. PATENT DOCUMENTS 4,803,917 A * 2/1989 Barbieri ..... 99/356
5,313,876 A * 5/1994 Hilger et al. ..... 99/330
5,909,933 A * 6/1999 Keene et al. ..... 312/140.1
6,182,305 B1 * 2/2001 O'Connell et al. ..... 4/631
6,192,791 B1 2/2001 Baker et al.
6,248,982 B1 * 6/2001 Reid et al. ..... 219/429
6,370,713 B2 * 4/2002 Bosio ..... 4/677
6,437,297 B2 8/2002 Weiss et al.
6,575,154 B1 * 6/2003 Freeman et al. ..... 126/40
6,588,325 B1 * 7/2003 Savage ..... 99/407
6,609,512 B2 * 8/2003 Poe, Jr. et al. ..... 126/25 A

* cited by examiner

KITCHEN COOKTOP SYSTEM

This application claims priority from U.S. Provisional Application No. 60/687,011 filed on Jun. 3, 2005, which is incorporated by reference.

TECHNICAL FIELD OF THE INVENTION

The invention relates to an apparatus for cleaning and maintaining a cooking appliance.

BACKGROUND AND SUMMARY OF THE INVENTION

Cooking appliances in the form of cooktops are well known in the prior art. Cooktops typically have one or more burners along with a flat cooking surface such as a griddle or grill. The construction of the typical burner assembly allows for food to drop under and liquids to seep under the burner, which requires removal of the cooktop to clean the burner assembly. Also, when meats and other foods are cooked on a griddle or grill, the cooking generates grease run-off that must be cleaned up after cooking is completed. In addition, food and liquid spilled onto a heated surface may become baked on if it is not quickly removed. The resulting baked-on food soils can be very labor-intensive to remove and often require the use of dangerous or corrosive cleaning compounds and chemicals. It may also be necessary to remove the cooktop for service and maintenance, such as to gain access to the gas system in gas stoves.

Lift-up cooktops for domestic ranges are well known. However, the typical apparatus employed for a domestic lift-up cooktop would not work for a commercial-type cooktop. Commercial-grade cooktops used in restaurants or institutional kitchens are typically very large and heavy, often weighing in excess of 500 pounds. Even if the commercial cooktop could be easily lifted, the sheer volume of food and grease that must be cleaned up in a commercial or institutional kitchen makes the cooktop and the area surrounding the cooktop much more difficult to clean in place than the typical domestic cooktop.

A thorough cleaning, which often requires flooding the cooktop with soap and water, is typically not practical while the appliance is in place. In order to maintain cleanliness and proper sanitation, it is often necessary to remove the appliance to allow maintenance and cleaning of the appliance and the areas around the appliance. In some cases, for example, restaurant cooktops are periodically disconnected and removed from the kitchen so that they can be thoroughly cleaned, sometimes by pressure washing or a similar procedure. Disconnecting and moving a large commercial cooktop often requires several people to accomplish as these appliances are not only heavy but also often awkwardly shaped and difficult to move in and out of the limited or confined spaces in which they are installed.

Further, the commercial cooktop is obviously out of service while it is being moved and cleaned. This can pose significant problems for kitchens that must operate 24 hours a day or for situations where a food spill needs to be cleaned immediately while the cooktop is being used.

What is needed is an improved apparatus for lifting and cleaning a large commercial-type cooktop.

SUMMARY OF THE INVENTION

An object of the invention, therefore, is to provide a kitchen cooktop system that allows the cooktop, including large commercial-type cooktops, to be easily cleaned without disconnecting or removing the appliance from the kitchen and that also allows the sides and bottom of the unit to be easily accessible for service or maintenance.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which.

DETAILED DESCRIPTION OF PREFERRED EMBODIMENTS

In a preferred embodiment, the present invention comprises a cooking appliance mounted so that the appliance can be easily raised for cleaning or service. The appliance is preferably mounted over a sink and drain so that the appliance can be easily and thoroughly cleaned and rinsed into the sink. In a preferred embodiment, the cooking appliance, such as a typical commercial cooktop, when in use will be lowered so that the base of the cooktop is seated into the sink opening. In this configuration, the cooktop is preferably flush with the surrounding countertops and the sink is hidden underneath the appliance. For cleaning the cooktop or for access to the base of the cooktop for service or repair, the entire appliance can be vertically raised, preferably by way of one or more hydraulic or pneumatic cylinders. Fuel gas (such as propane or natural gas) and/or electrical connections to the cooking appliance can be provided by flexible code-compliant hose and/or conduit. Also in a preferred embodiment, these flexible connections can pass through pipes raised above the bottom of the sink (standpipes) so that the connections can be maintained while the cooking appliance is raised or lowered but no water will leak from the sink while in use. A similar raised pipe can be used to pass the pneumatic or hydraulic lift cylinder. A hot water connection is preferably available at the sink with a water supply device such as a typical pot-filler type fixture and flexible hose that can be used to direct water at the exterior surfaces of the cooking appliance and the sink basin.

A preferred embodiment of the present invention thus allows easy access to the bottom and sides of the cooking appliance, and when coupled with the sink, drain, and flexible hot water supply, enables thorough daily cleaning in a relatively short time period. When raised, the sides and bottom of the cooking appliance as well as the accompanying sink can be soaped and rinsed into the drain. The use of a lift cylinder or similar device allows the entire operation to be performed by a single operator.

Figure 1:
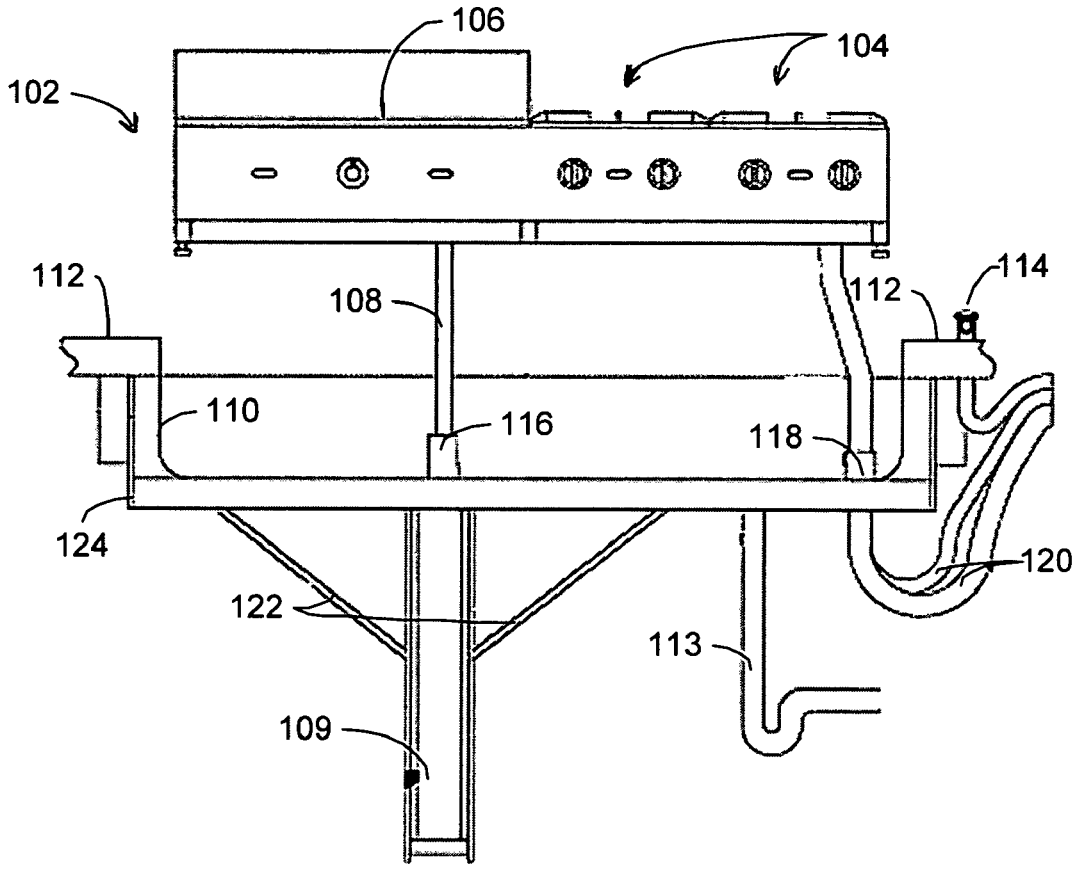
FIG. 1 shows a front view of a preferred embodiment of an apparatus according to the present invention with the cooking appliance raised for cleaning or service.
Figure 2:
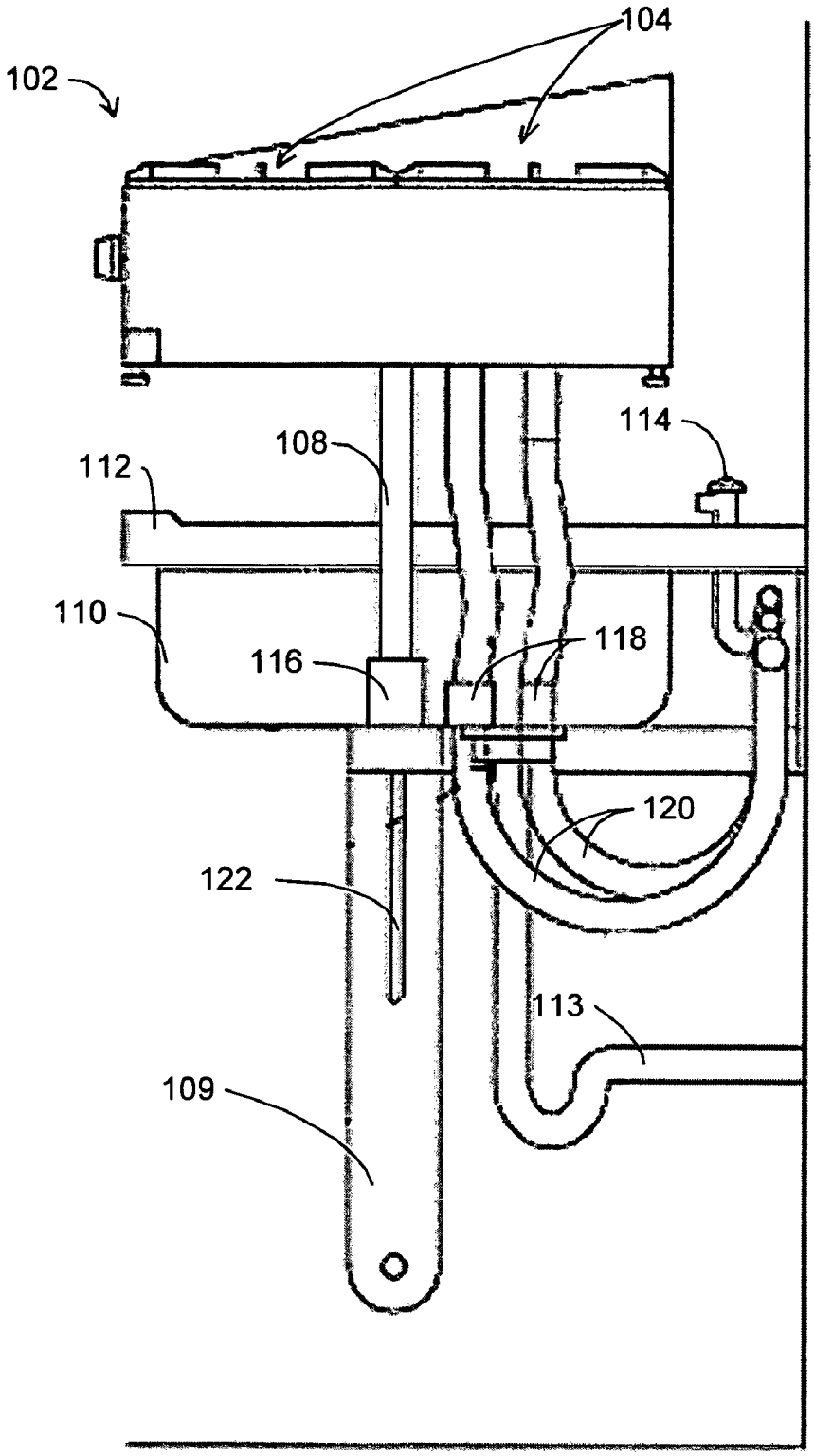
FIG. 2 is a side view of the apparatus of FIG. 1.

FIG. 1 shows a front view of a preferred embodiment of the present invention with the cooking appliance raised for cleaning or service. FIG. 2 is a side view of the apparatus of FIG. 1. In FIG. 1 and FIG. 2, the cooking appliance is a typical commercial gas cooktop 102 with gas burners 104 and a flat griddle surface 106. A typical cooktop of this type can weigh approximately 500 pounds. Cooktop 102 is mounted onto a vertically positioned lift cylinder 108 so that the cooktop 102 can be easily raised and lowered. Cooktop 102 is also mounted over sink 110 so that the cooktop 102 will seat into the sink 110 when lowered. The sink 110 serves as a drip pan for the cooktop and provides catchment for all the soap and rinse used during a cleaning operation.

Figure 3:
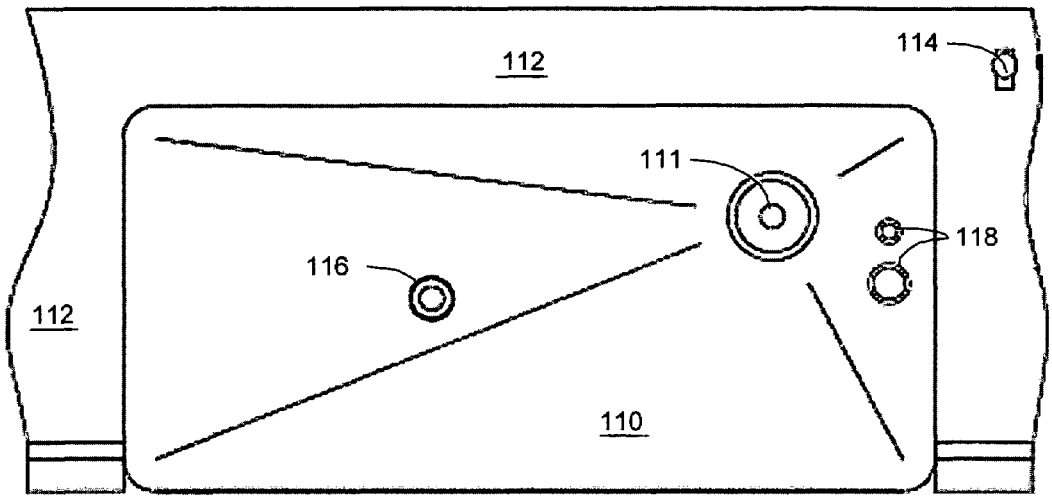
FIG. 3 is a top down view of the sink basin in a preferred embodiment of the present invention.

Referring also to FIG. 3, sink 110 is preferably a flush mount stainless steel sink with a drain 111 connected to drainpipe 113 and can be either a drop-in or weld-in type. Sink 110 is mounted onto countertop 112. Hot water for cleaning the cooktop 102 and sink 110 is provided through pot-filler fixture 114 with a flexible hose mounted beside the sink. The hot water connection is preferably accessible when the cooktop is lowered and in use so that it can also function as a traditional pot-filler. The lift cylinder base 109 is vertically mounted beneath the sink 110 so that the lift cylinder extends through a hole in the bottom of the sink basin. Lift cylinder 108 also passes through cylinder standpipe 116, which is preferably welded to the floor of sink around the hole.

Gas and/or electrical connections 120 to the cooking appliance can be provided by or housed within flexible code-compliant hose and/or conduit. The flexible hose is passed through connection standpipes 118 also preferably welded to the floor of the sink. The standpipes 116 and 118 will preferably be tall enough so that when the sink is in use the water level in the sink will not rise to the top of the standpipe. In this way the lift cylinder 108 and gas/electrical connections 120 can pass through the floor of the sink without allowing any water to leak through the openings and ensuring a watertight passage of fluid to the sink drain and drainpipe. The exact location of the cylinder standpipe 116 is determined by the desired location of the lift cylinder. The placement of gas/electric connection standpipes 118 will depend upon the location of the cooktop connections, although the connection standpipes and cooktop connections need not be exactly aligned where flexible hose or conduit is used for the connections.

In a preferred embodiment, the gas and/or electrical connections can be maintained while the cooktop is raised and lowered. As a result, the cooktop can actually be raised and lowered while in use so that a spill can be immediately cleaned up without interrupting cooking.

The base of lift cylinder 108 is supported by steel framework 122 attached to the bottom of the countertop frame 124 that supports the sink. The lift cylinder head can be mounted onto a frame or support that is attached to the base of the cooktop. The location of the lift cylinder with respect to the cooktop will be determined by the center of gravity of the cooktop (front to back and side to side). In a preferred embodiment of the present invention the frame or support attached to the base of the cooktop can simply be two metal supports attached to the sides of the cooktop base and crossing at the location of the appliance center of gravity. The lift cylinder is then attached to the frame at the point where the two support members cross.

In the embodiment shown in FIG. 1, the lift cylinder 108 is a double acting pneumatic lift cylinder. In a preferred embodiment, a pneumatic cylinder can be controlled by a 5-port selector valve with air pressure provided by a compressor through a pressure regulator and oiler. The exhaust air for raising and lowering can be controlled individually through metering valve ports in order to maintain positive pressure on both sides of the lift piston. This arrangement allows the speed and consistency of operation to be controlled, both during lifting and lowering.

The selector valve can be operated by way of a control valve lever, which is preferably mounted near the cooking appliance for easy access. In a preferred embodiment of the present invention, the lifting function is initiated by moving the control valve lever to the "raise" position, which provides pressure to the bottom of the piston of the lift cylinder. When raised to desired height the control valve is returned to the center position to eliminate further movement. For a cooktop weighing approximately 500 pounds, the bore for the lift cylinder will preferably be approximately 3.5 inches. An air pressure of approximately 70 p.s.i. will be required to achieve smooth operation and reasonable speed while lifting the 500-pound cooktop. Adjustments in pressure as well as exhaust metering can be used to vary the lifting capacity and lifting and lowering speeds. After cleaning or service is complete the control valve lever is moved to the "lower" position to return the appliance to the original position. With lowering complete, the control valve lever is returned to the center position.

In addition to the pneumatic cylinder shown in FIG. 1 and FIG. 2, skilled persons will recognize that the cooktop of the present invention could be raised and lowered by a number of known methods including but not limited to a hydraulic cylinder, an electrical mechanism such as a gear and pulley system operated by an electric motor, or a manual mechanism such as a mechanism operated by a manual hand crank.

The present invention can be readily adapted to many commercially available cooktops or other countertop or hotplate design cooking appliances. In order to customize an installation for a particular cooktop or other cooking appliance, the drop-in or weld-in sink to be used should have dimensions large enough to accommodate the dimensions of the appliance. A lift cylinder should be selected having sufficient size and strength to accommodate the weight of the appliance. And finally, holes should be cut in the bottom of the sink and standpipes installed at the desired locations for the lift cylinder (determined by the center of gravity of the appliance) and the gas and/or electrical connections (determined by the location of the connections on the particular cooking appliance to be installed).

A preferred embodiment of the present invention thus allows the bottom and sides of a cooking appliance to be easily accessed for cleaning or service. When the cooking appliance is raised, water and soap (or other cleaning agents) can be used to wash down the entire cooking appliance. The water and soap, along with any food spills or other soils, flow into the sink and out through the sink drain. No disassembly or disconnection of the appliance is required and the use of a pneumatic or other lifting device allows the entire operation to be carried out by one person.

Although much of the previous description is directed toward a commercial cooktop, the present invention could be utilized with any cooking apparatus, whether intended for commercial or domestic use, that requires periodic maintenance and cleaning, including for example a gas or electric grill. Hence, the scope of the present invention should not be limited to a commercial-type cooktop. Further, the use of the phrase "commercial-type" is used to refer to commercial grade cooking equipment, which is normally larger, heavier, and designed for a higher volume of use than equipment intended for domestic use, and is not intended to limit the present invention to a cooking apparatus actually used in a restaurant or institutional kitchen. Also, the word "conduit" as used herein can refer to any tube, pipe, or hose, whether rigid or flexible.

Although the present invention and its advantages have been described in detail, it should be understood that various changes, substitutions and alterations can be made to the embodiments described herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

I claim:

1. A cooking apparatus comprising:

a cooktop having a base;

a sink having a basin and drain mounted underneath said cooktop;

a conduit for directing water at the exterior surfaces of the cooktop;

a device for vertically moving the cooktop from a lowered position in which the base of the cooktop is seated substantially within the basin of said sink to a raised configuration in which the cooktop is vertically raised above the sink to a distance sufficient to allow water to be directed at the bottom and sides of said cooktop.

2. The apparatus of claim 1 in which the conduit is a flexible hose.

3. The apparatus of claim 1 further comprising a pot-filler type water fixture connected to the conduit.

4. The apparatus of claim 1 in which the sink is flush mounted onto a countertop.

5. The apparatus of claim 1 in which the width and length of the sink basin are greater than the width and length of the cooking appliance.

6. The apparatus of claim 1 in which the cooktop weighs at least 500 pounds.

7. The apparatus of claim 1 in which the device for vertically moving the cooktop comprises:

a pneumatic air cylinder;

a support frame attached to the base of cooktop; and said pneumatic air cylinder attached to said frame at the center of gravity of the cooktop.

8. The apparatus of claim 1, further comprising a sprayer for directing a liquid to the exterior surfaces of the cooktop.

9. The apparatus of claim 1 in which the cooktop is flush mounted onto a countertop.

10. The apparatus of claim 1 in which the device for vertically moving the cooktop comprises a manual mechanical mechanism operated by a manual hand crank.

11. A cooking apparatus comprising:

a cooking appliance having a base;

a sink having a basin and drain mounted underneath said cooking appliance;

a conduit for directing water at the exterior surfaces of the cooking appliance;

a device for vertically moving the cooking appliance from a lowered position in which the base of the cooking appliance is seated substantially within the basin of said sink to a raised configuration in which the cooking appliance is vertically raised above the sink to a distance sufficient to allow water to be directed at the bottom and sides of said cooking appliance; and a conduit providing either a fuel gas or electrical connection to said cooking appliance.

12. The apparatus of claim 11 in which said cooking appliance can be moved from a lowered configuration to a raised configuration without disconnecting said fuel gas or electrical connection.

13. The apparatus of claim 11 in which said cooking appliance has at least one heated cooking surface and in which said heated cooking surface can be operated with the cooking appliance in either the lowered or raised configuration.

14. The apparatus of claim 11 in which said conduit providing either a fuel gas or electrical connection comprises a flexible conduit; and at least one flexible conduit providing either a fuel gas or electrical connection passes through a hole in the bottom of the sink basin, said hole surrounded by a raised pipe section of a height sufficient to prevent water in the sink basin from escaping through the hole.

15. A cooking apparatus comprising:

a sink having a basin and drain;

a cooktop having a base, said cooktop moveable from a lowered position in which the base of the cooktop is seated substantially within the basin of said sink to a raised position in which the cooktop is vertically raised above the sink to a distance sufficient to allow access to the bottom and sides of said cooktop, and a mechanism for raising and lowering the cooktop, wherein the cooktop is moved from the lowered position to the raised position by activating the mechanism.

16. The cooking apparatus of claim 15, wherein the cooktop is moved from the raised position to the lowered position by activating the mechanism.

* * * * *